US006886285B1

(12) United States Patent
Sirkis et al.

(10) Patent No.: US 6,886,285 B1
(45) Date of Patent: May 3, 2005

(54) THREE-POSITION SAFETY FOR A BOLT-ACTION RIFLE

(75) Inventors: Nehemia Sirkis, Hollywood, FL (US); Peter J. Hylenski, Danbury, CT (US)

(73) Assignee: Kimber IP, LLC, Yonkers, NY (US)

( * ) Notice: Subject to any disclaimer, the term of this patent is extended or adjusted under 35 U.S.C. 154(b) by 0 days.

(21) Appl. No.: 10/772,018

(22) Filed: Feb. 4, 2004

(51) Int. Cl.[7] ..... F41A 17/00
(52) U.S. Cl. ..... 42/70.08; 42/70.01; 89/148
(58) Field of Search ..... 42/70.08, 70.01; 89/148

(56) References Cited

U.S. PATENT DOCUMENTS

| | | | | | |
|---|---|---|---|---|---|
| 1,318,423 | A | * | 10/1919 | Williams | 42/16 |
| 1,545,045 | A | * | 7/1925 | Dute | 42/16 |
| 2,824,402 | A | * | 2/1958 | Fischer | 42/70.01 |
| 2,869,269 | A | * | 1/1959 | Couture | |
| 3,138,888 | A | * | 6/1964 | Brewer | |
| 3,830,002 | A | * | 8/1974 | Volkmar | 42/70.08 |
| 3,838,533 | A | * | 10/1974 | Ruger | 42/70.08 |
| 3,894,474 | A | * | 7/1975 | Tanfoglio | 89/148 |
| 4,117,761 | A | | 10/1978 | Johnson et al. | |
| 4,305,218 | A | * | 12/1981 | Godsey | 42/70.08 |
| 4,445,292 | A | * | 5/1984 | Martin | 42/16 |
| 4,870,770 | A | * | 10/1989 | Forbes et al. | 42/70.01 |
| 5,245,776 | A | * | 9/1993 | Dornaus | 42/70.08 |
| 5,551,180 | A | * | 9/1996 | Findlay et al. | 42/70.01 |
| 6,401,378 | B1 | * | 6/2002 | Ockenfuss | 42/70.01 |
| 6,418,655 | B1 | * | 7/2002 | Kay | 42/70.08 |
| 6,508,025 | B1 | * | 1/2003 | Du Plessis | 42/16 |
| 2003/0213158 | A1 | * | 11/2003 | Recknagel | |
| 2004/0211102 | A1 | * | 10/2004 | Prechtl | |

FOREIGN PATENT DOCUMENTS

| | | | | |
|---|---|---|---|---|
| EP | 0 143 114 | * | 6/1985 | 42/70.08 |
| EP | 0 529 871 | * | 8/1992 | 42/70.08 |

OTHER PUBLICATIONS

Hawks, Chuck, "The Rifleman's Rifle: Winchester's Model 70", *Manual* 2002, pp. 1–7, website: www.chuckhawks.com/win70.htm.

"Winchester Rifles and Shotguns", Winchester Model 70 Take–Down Rifle Supplement, date unknown.

"Winchester Rifles and Shotguns", Winchester Model 70 Bolt Action Rifle Owner's Manual, 25 pages, date unknown; websit: www.winchester–guns.com.

Winchester Model 70 Bolt Acton Centerfire Rifle, Gun Parts List, pp. 105–108, date unknown.

* cited by examiner

*Primary Examiner*—Michael J. Carone
*Assistant Examiner*—Lulit Semunegus
(74) *Attorney, Agent, or Firm*—Caesar, Rivise, Bernstein, Cohen & Pokotilow, Ltd.

(57) ABSTRACT

A three-position safety for a firearm is provided that includes a lever that is rotatable from a first position wherein the bolt and the firing pin are unlocked, to a second position wherein the bolt is unlocked and the firing pin is locked, to a third position wherein the bolt and the firing pin are locked. A detent member has a detent surface to mate with detent apertures on the end of the bolt. When the safety lever is in a first position or a second position, a gap exists between the shaft of the plunger and the detent member allowing for rotational movement of the bolt relative to a cocking piece housing. When the safety lever is in a third position, the shaft of the plunger contacts the detent member such that no rotational movement of the bolt is provided.

6 Claims, 5 Drawing Sheets

FIG.10
(PRIOR ART)
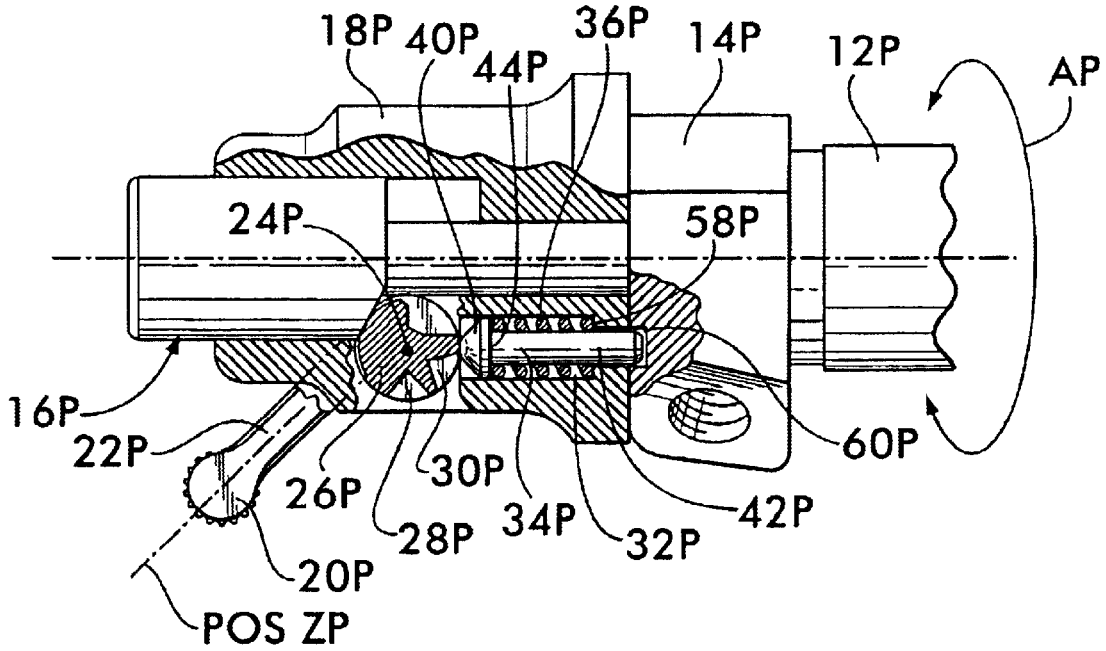
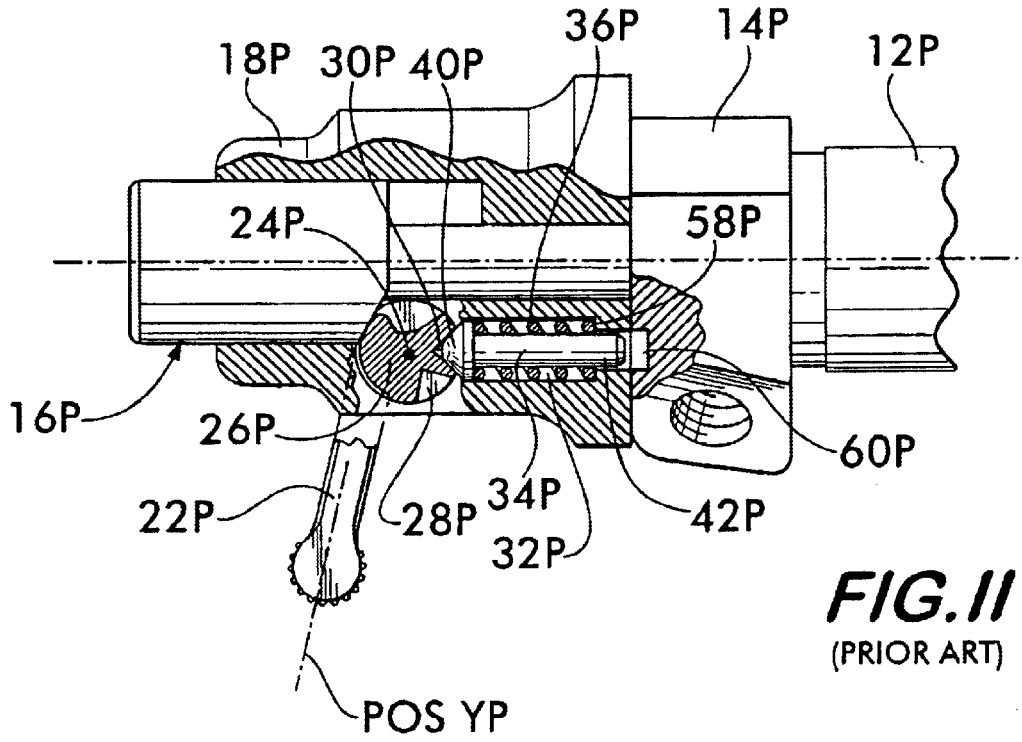
FIG.11
(PRIOR ART)

THREE-POSITION SAFETY FOR A BOLT-ACTION RIFLE

BACKGROUND OF THE INVENTION

This invention relates to firearms in general. More particularly, this invention relates to safeties for bolt-action rifles.

The Winchester Model 70 Bolt-Action Rifle has been around for many decades. Many rifle manufactures make variations of this bolt action rifle, but the basic design has remained generally unchanged for decades. This rifle type has a "bolt-action" design wherein a person shooting the rifle loads a round by causing the rifle to move a cartridge from a loaded magazine to the chamber of the gun. In a conventional Model 70 design, to load a round, the shooter first loads the magazine by rotating the bolt handle up (counterclockwise). The bolt handle is rotated counterclockwise and, once rotated, the bolt is pulled back all the way such that the receiver is opened for accepting a cartridge. The shooter presses the cartridge down into the magazine, presses another cartridge down into the magazine, etc. until the magazine is loaded to capacity. To shoot, the bolt is pushed forward and then rotated down (using its bolt handle). The safety is rotated forward to a ready to fire position. The shooter then fires the rifle. Once fired, the bolt handle is rotated up (counterclockwise) and then pulled rearward until the fired cartridge is ejected by the rifle. The bolt is then pushed forward which moves a cartridge from the magazine into the firing chamber and the bolt is then again rotated clockwise.

One feature common to Winchester Model 70 type rifles is a three-position safety. In its first position where the safety lever is rotated to its forward-most position, both the bolt and the firing pin are unlocked and the rifle is ready to fire. In its second position where the safety is in its second, intermediate, position, the bolt is unlocked, but the firing pin is in its locked position. Finally, in its third position, both the bolt and the firing pin are in locked positions.

While the design of the three position safety of the Winchester Model 70 type rifle and rifles of similar design is adequate, it would be desirable to simplify the mechanism in order to produce a more cost-effective design. For example, the elimination of some of the individual parts of the safety by incorporating their functions into other elements of the safety design would be desirable so long as the modified design maintains the high level of safety and reliability of the original three position safety design.

Further, it would be advantageous to have a three position safety that is simpler to manufacture and that uses fewer parts, thereby maintaining quality, while, at the same time, reducing costs.

All references cited herein are incorporated herein by reference in their entireties.

BRIEF SUMMARY OF THE INVENTION

A three-position safety for a firearm is provided. The firearm has a bolt, a firing pin having a cocking piece, and a cocking piece housing. The bolt is axially rotatable relative to the cocking piece housing. The safety includes a safety lever that is rotatable in the cocking piece housing from a first position wherein the bolt and the firing pin are in an unlocked position, to a second position wherein the bolt is in an unlocked position and the firing pin in a locked position, to a third position wherein the bolt and the firing pin are in a locked position. The safety lever has a handle, a pivot point, and a detent leg. The detent leg has a first detent aperture corresponding to the first position and a second detent aperture corresponding to the second position. A bore in the cocking piece housing provides an opening between an end of the bolt and the detent leg. The end of the bolt has an end adjacent to the cocking piece housing. A plunger has a first detent surface to mate with one of the first and second detent apertures on the detent leg and a shaft opposite to the first detent surface. A detent member has a second detent surface to mate with a third detent aperture and a fourth detent aperture on the end of the bolt adjacent to the cocking piece housing. A biasing member urges the plunger towards the lever and urges the detent member towards the end of the bolt adjacent to the cocking piece housing.

When the safety lever is in the first position (when the bolt and firing pin are in the unlocked position), the first detent surface of the plunger is urged by the biasing member to extend into the first detent aperture in the safety lever, the second detent surface of the detent member is urged into the third detent aperture on the end of the bolt, and a gap exists between the shaft of the plunger and the detent member allowing for rotational movement of the bolt relative to the cocking piece housing.

When the safety lever is in the second position (when the bolt is in an unlocked position and the firing pin in a locked position), the first detent surface of the plunger is urged by the biasing member to extend into the second detent aperture in the safety lever, the second detent surface of the detent member is urged into third detent on the end of the bolt, and a gap exists between the shaft of the plunger and the detent member allowing for rotational movement of the bolt relative to the cocking piece housing.

When the safety lever is in the third position (when the bolt and the firing pin are in locked position), the first detent surface of the plunger contacts the safety lever at a position that is not aligned with the first and second apertures of the safety lever and the second detent surface of the detent member is urged into third detent on the end of the bolt, such that the shaft of the plunger contacts the detent member such that no rotational movement of the bolt relative to the cocking piece housing is provided.

Preferably, the biasing member is a coil spring coaxial to the shaft that extends between a point adjacent to the first detent surface of the plunger to the detent member. Preferably, the detent member is a ball. Optionally, the detent member may be a second plunger having a second detent surface. Here, the second plunger may have a second detent surface to mate with the detent aperture on the end of the bolt adjacent to the cocking piece housing. Additionally, here, the biasing member may be a coil spring coaxial to the shaft extending between a point adjacent to the first detent surface of the plunger to the a point adjacent to the second detent surface of the second plunger.

BRIEF DESCRIPTION OF SEVERAL VIEWS OF THE DRAWINGS

The invention will be described in conjunction with the following drawings in which like reference numerals designate like elements and wherein:

FIG. 10 is a partial, top, cross-sectional view of a three-position safety for a prior art, Winchester Model 70 type three position safety, where the safety is positioned such that the bolt is in a locked position and the firing pin is in a locked position; and FIG. 11 is a partial, top, cross-sectional view of a three-position safety for a prior art, Winchester Model 70 type three position safety, where the safety is positioned such that the bolt is in an unlocked position and the firing pin is in a locked position.

DETAILED DESCRIPTION OF THE INVENTION

Figure 1:
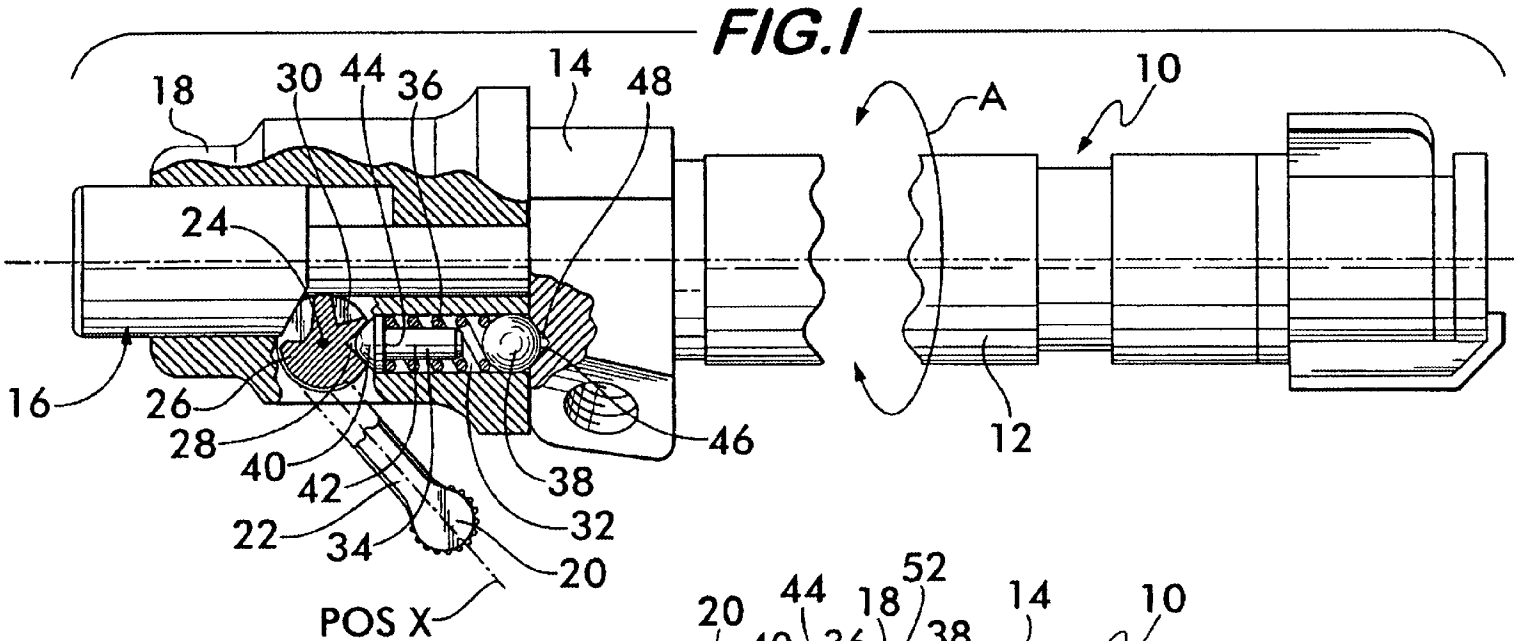
FIG. 1 is a partial, top, cross-sectional view of a three-position safety for a bolt-action rifle in accordance with one preferred embodiment of the present invention, where the safety is positioned for the rifle to be fired.
Figure 2:
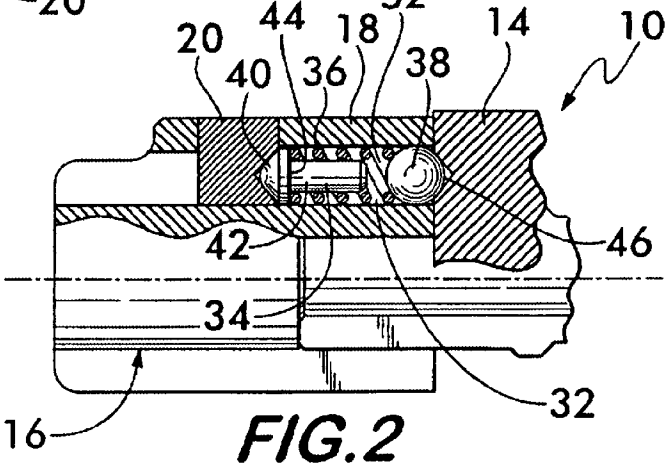
FIG. 2 is a partial, side, cross-sectional view of the three-position safety for the bolt-action rifle of FIG. 1 where the safety is positioned for the rifle to be fired.
Figure 3:
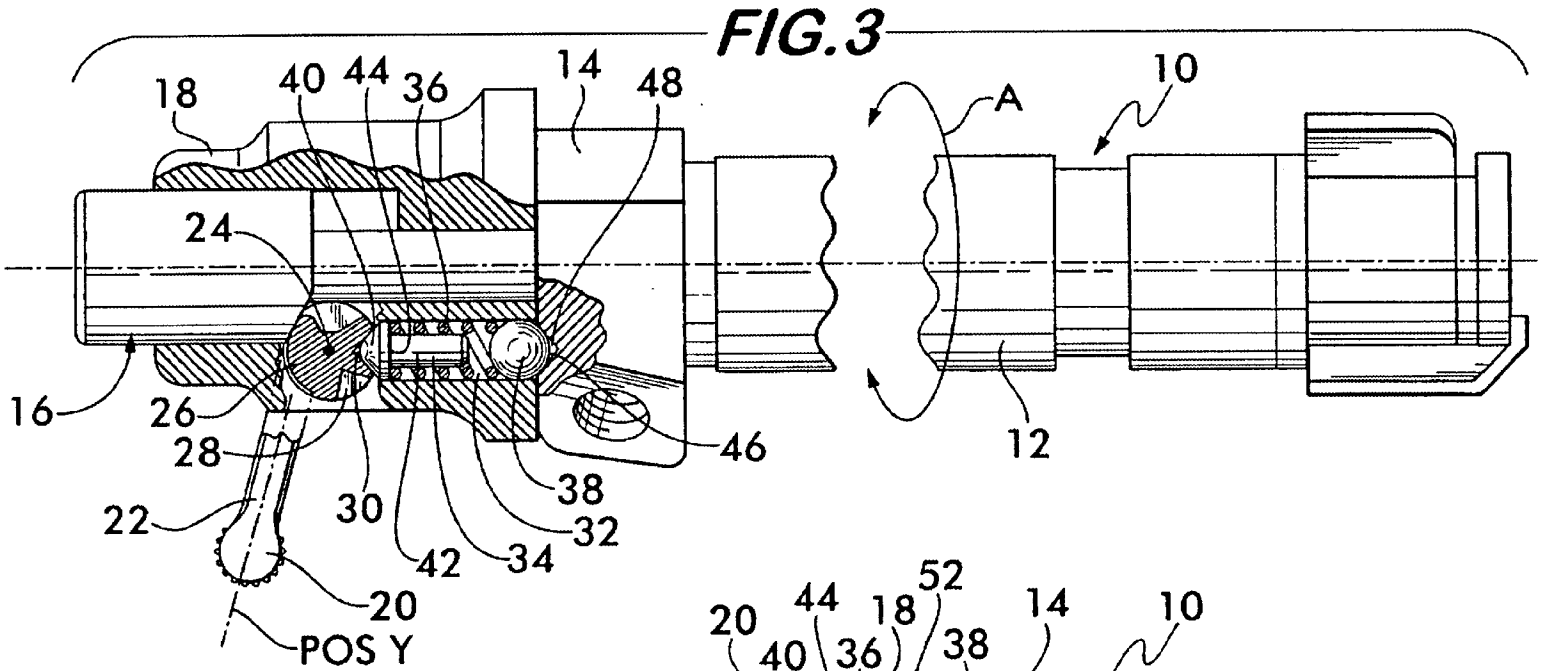
FIG. 3 is a partial, top, cross-sectional view of a three-position safety for the bolt-action rifle of FIG. 1, where the safety is positioned such that the bolt is in an unlocked position and the firing pin is in a locked position.
Figure 4:
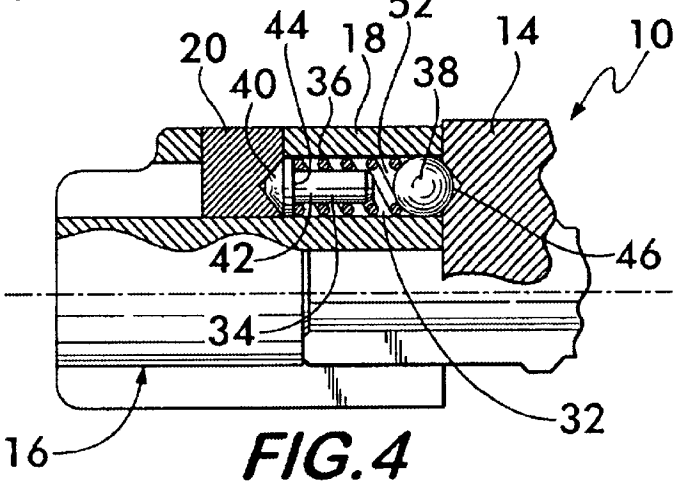
FIG. 4 is a partial, side, cross-sectional view of the three-position safety for the bolt-action rifle of FIG. 1 where the safety is positioned such that the bolt is in an unlocked position and the firing pin is in a locked position.
Figure 5:
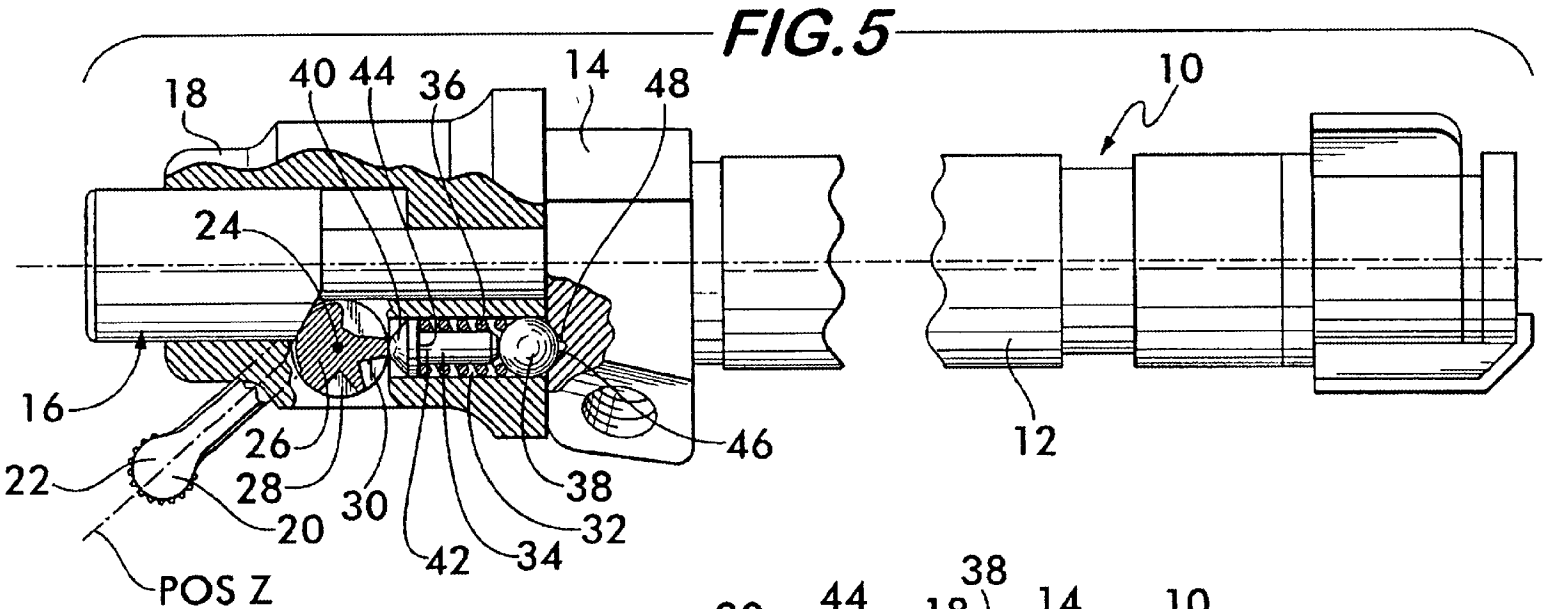
FIG. 5 is a partial, top, cross-sectional view of a three-position safety for the bolt-action rifle of FIG. 1, where the safety is positioned such that the bolt is in a locked position and the firing pin is in a locked position.
Figure 6:
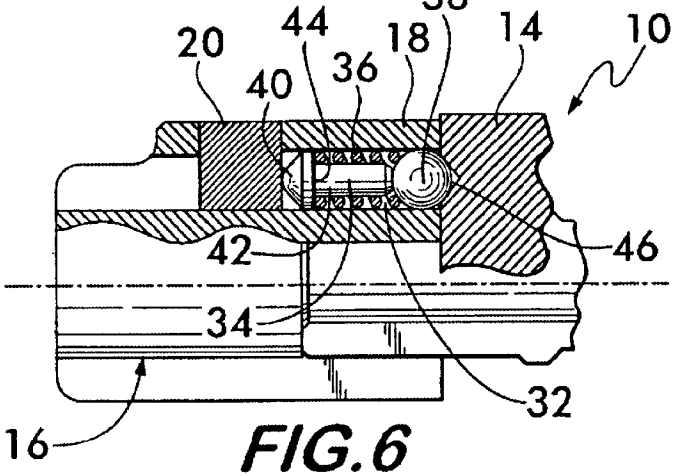
FIG. 6 is a partial, side, cross-sectional view of the three-position safety for the bolt-action rifle of FIG. 1 where the safety is positioned such that the bolt is in a locked position and the firing pin is in a locked position.

The invention will be illustrated in more detail with reference to the following embodiments, but it should be understood that the present invention is not deemed to be limited thereto.

Referring now to the drawings, wherein like part numbers refer to like elements throughout the several views, there is shown in FIGS. 1 through 6 a three-position safety for a bolt-action rifle 10 in accordance with one preferred embodiment of the present invention.

The three-position safety 10 is of a similar design to that used for many years for the Winchester Model 70 Bolt Action Centerfire Rifle, as is very well known. The general design of the primary components of the Winchester Model 70 are used with modification to several of the elements to provide for the benefits of the present invention. The rifle 10 generally includes a stock assembly, a magazine and associated hardware and a trigger and associated hardware. These elements are not shown, but are very well known to those skilled in the art of rifle design as the Model 70 has been around for many decades and is considered a "classic" rifle design. The Model 70 type safety is described in further detail below with respect to FIGS. 9 and 10. As shown in FIGS. 1–6, a preferred embodiment of the rifle 10 of the present invention further includes a barrel assembly 12, a bolt 14, a firing pin having an integral cocking piece 16, and a cocking piece housing 18. The bolt 14 is rotatable relative to the cocking piece housing 18.

The safety includes a safety lever 20 that is rotatable in the cocking piece housing 18 (also known as a breech bolt sleeve) in direction A from a first position X (see FIG. 1) wherein the bolt and the firing pin are in an unlocked position, to a second position Y (see FIG. 3) wherein the bolt is in an unlocked position and the firing pin in a locked position, to a third position Z (see FIG. 5) wherein the bolt and the firing pin are in locked position.

The safety lever 20 has a handle 22, a pivot point 24 and a detent leg 26. The detent leg 26 has a first detent aperture 28 corresponding to the first position X and a second detent aperture 30 corresponding to the second position Y. The detent apertures 28 may be, for example, a hole, an indentation (for example, a hemispherical indentation), a groove, or the like that allows a mating detent surface to "click" into place at each positions. The cocking piece housing 18 has a bore (circular or non-circular) 32 that provides an opening between an end of the bolt 14 and detent leg 26. The end of the bolt 14 is adjacent to the cocking piece housing 18.

Located in the bore 32 is a plunger 34, a biasing member in the form of a coil spring 36 and a detent member 38. The plunger 34 has a first detent surface to 40 that is adapted to mate with either of the first detent aperture 28 or second detent aperture 30 on the detent leg 26 of the safety lever 20. Opposite to the first detent surface 40 is a shaft 42 about which the coil spring 36 is inserted. Preferably, the shaft 42 is of a smaller cross sectional area than the bottom side of the first detent surface 40 such that a rim 44 is formed upon which an end of the coil spring 36 abuts. The cross sectional shape of the bore 32 (for example, circular) is preferably substantially the same as that of the outer perimeter shape of the first detent surface, but with adequate clearance such that the plunger is free to move axially within the bore 32. The second end of the coil spring 36 abuts the detent member 38 which also has substantially the same cross sectional shape as that of the bore and also having adequate clearance such that the detent member 38 is free to move axially within the bore 32. As shown in the figures of the first embodiment, the detent member is spherical in shape. For example, if the bore 32 is a circular bore, the outer perimeter of the first detent surface is also circular (but of a slightly smaller diameter) and the detent member is spherical (also of a slightly smaller diameter than the bore 32).

The detent member 38 has a second detent surface 46. As shown, the second detent surface 46 is merely a portion of the surface of the sphere. The second detent surface 46 mates with a third detent aperture 48 on the end of the bolt 14 adjacent to the cocking piece housing 18. The coil spring 36 urges the plunger 34 towards the safety lever 20 and, simultaneously, urges the detent member 38 towards the end of the bolt 14 adjacent to the cocking piece housing 18.

When the safety lever 20 is rotated about pivot point 24 to the first position X, that is, when the bolt 14 and firing pin having a cocking piece 16 are in the unlocked position, the first detent surface 40 of the plunger 34 is urged by the coil spring 36 to extend into the first detent aperture 28 in the safety lever detent leg 26 and the second detent surface 46 of the detent member 38 is urged into the third detent aperture on the end of the bolt 14. In the first position X, a gap 52 exists between the shaft 42 of the plunger 34 and the detent member 38. The gap provides for movement of the detent member 38 in the bore 32, allowing for rotational movement (in direction A) of the bolt 14 relative to the cocking piece housing 18.

When the safety lever 20 is rotated about pivot point 24 to the second position Y, that is, when the bolt 14 is in an unlocked position and the firing pin cocking piece 18 is in a locked position, the first detent surface 40 of the plunger 34 is urged by the coil spring 36 to extend into the second detent aperture 30 in the safety lever detent leg 26, and the second detent surface 46 of the detent member 38 is urged into third detent aperture 48 (on the end of the bolt 14). Again, the gap 52 exists between the shaft 42 of the plunger 34 and the detent member 38. Again, the gap provides for rotational movement (in direction A) of the bolt 14 relative to the cocking piece housing 18.

When the safety lever 20 is rotated about pivot pin 24 to the third position Z, that is, when the bolt 14 and the firing pin cocking piece 18 are in locked position, the first detent surface 40 of the plunger 34 makes direct contact with the detent leg 26 of the the safety lever 20 at a position that is not aligned with the first and second detent apertures 28, 30 of the safety lever. The second detent surface 40 of the detent member 38 is urged into the third detent aperture on the end of the bolt 48. In this configuration, the shaft 42 of the plunger 34 directly contacts the detent member 38. That is, no substantially no gap exists between the detent leg 26 of the safety lever 20, the plunger 34 and the detent member 38 such that no rotational movement of the bolt 14 relative to the cocking piece housing 18 is provided because the detent member 38 effectively locks to the third detent aperture 48 in the end of the bolt 14.

When the bolt 14 is rotated from the down position to the up position, the detent member 38 moves from the third detent aperture 48 to a fourth detent aperture (not shown) on the end of the bolt 14 adjacent to the cocking piece housing 18 to maintain alignment between the cocking piece housing 18 and the bolt 14. When the bolt is moved to the rear during operation of the firearm, alignment of the cocking piece housing 18 with respect to the bolt 14 is maintained.

As indicated, preferably, coil spring 36 surrounds the shaft 42 of the plunger as shown in the figures. However, any known biasing member 36 may be used, for example, a rubber grommet.

Figure 7:
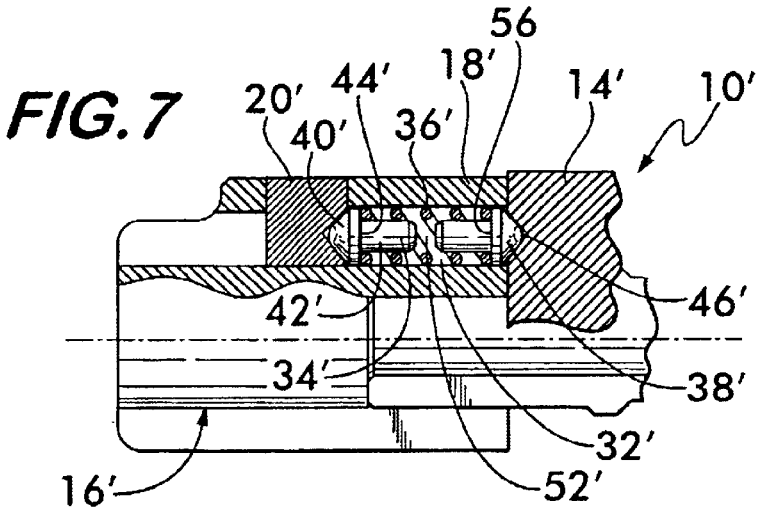
FIG. 7 is a partial, side cross-sectional view of a three-position safety for a bolt-action rifle in accordance with a second preferred embodiment of the present invention, where the safety is positioned for the rifle to be fired.
Figure 8:
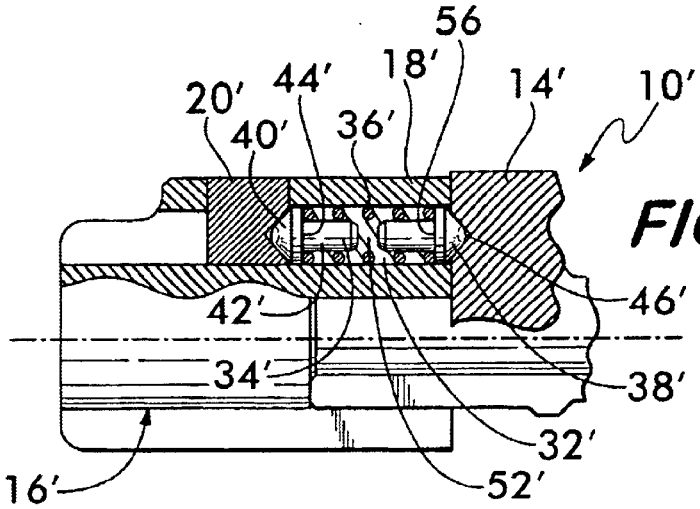
FIG. 8 is a partial, side cross-sectional view of a three-position safety for the bolt-action rifle of FIG. 7, where the safety is positioned such that the bolt is in an unlocked position and the firing pin is in a locked position.
Figure 9:
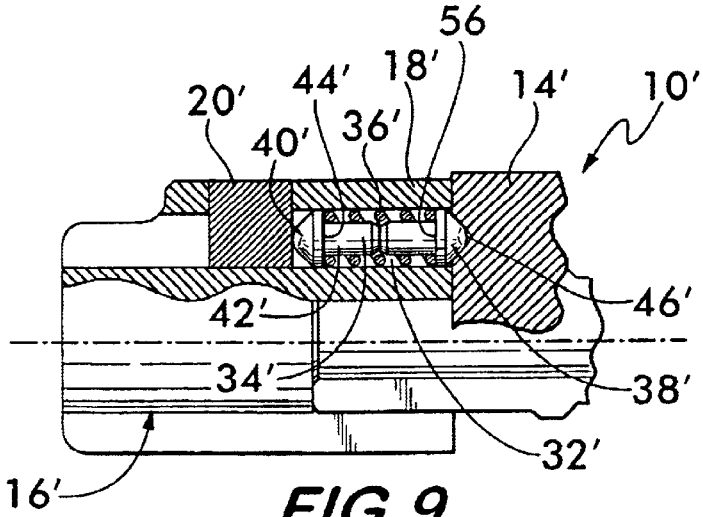
FIG. 9 is a partial, side cross-sectional view of a three-position safety for the bolt-action rifle of FIG. 7, where the safety is positioned such that the bolt is in a locked position and the firing pin is in a locked position.

As shown in FIGS. 1–6, the detent member 38 is preferably in the form of a spherical ball. However, as can be seen in the alternate embodiment of the rifle 10' of FIGS. 7–9, the detent member 38 (of the first embodiment) is included in the form of a second plunger 38' having a second detent surface 46'. For the sake of simplicity, elements of the second embodiment that are identical to those of the first embodiment will be numbered the same as those of the first embodiment with the addition of an apostrophe. For example, the safety lever 20 of the first embodiment is substantially identical to the safety lever 20' of the second embodiment. As can be seen in FIGS. 7–9, the detent member 38' in the form of a second plunger operates in a substantially identical manner to the spherical detent member 38 in the form of a spherical ball. One end of the coil spring 36' bears against the rim 44 of the plunger 34. The other end of the coil spring bears against another rim 56 the second plunger 38'. The second plunger 38' has the second detent surface 46' to mate with the third detent aperture 48' on the end of the bolt 14' adjacent to the cocking piece housing 18' and a shaft 42' opposite to the second detent surface 46.

The present invention is a modification of a Winchester Model 70-type three position safety that provides for cost savings over the design of the Model 70-type safety in that several parts and machining operations are eliminated. The present invention combines the three position safety system and the cocking piece housing locating system of the Winchester Model 70 design.

The three-position safety of the Winchester Model 70 Bolt Action Centerfire Rifle is very well known. The design is generally shown in FIGS. 10 and 11. The Model 70 rifle generally includes a stock assembly, a magazine and associated hardware and a trigger and associated hardware. These elements are not shown, but are very well known to those skilled in the art of rifle design as the Model 70 has been around for many decades and is considered a "classic" rifle design. As can be seen in FIGS. 10 and 11, the prior art three-position safety includes a barrel assembly 12P, a bolt 14P, a firing pin having an integral cocking piece 16P, and a cocking piece housing 18P. The bolt 14P is rotatable relative to the cocking piece housing 18P.

As can be seen in FIGS. 10 and 11, the prior art safety includes a safety lever 20P that is rotatable in the cocking piece housing 18P (also known as a breech bolt sleeve) in direction AP from a first position (not shown) wherein the bolt and the firing pin are in an unlocked position, to a second position YP wherein the bolt is in an unlocked position and the firing pin in a locked position, to a third position ZP wherein the bolt and the firing pin are in locked position.

The safety lever 20P has a handle 22P, a pivot point 24P and a detent leg 26P. The detent leg 26P has a first detent aperture 28P corresponding to the first position and a second detent aperture 30P corresponding to the second position YP. The cocking piece housing 18P has a circular bore 32P that provides an opening between an end of the bolt 14P and detent leg 26P. The end of the bolt 14P is adjacent to the cocking piece housing 18P.

Located in the bore 32P is a plunger 34P and a coil spring 36P. The plunger 34A has a first detent surface 40P that mates with either of the first detent aperture 28P or second detent aperture 30P on the detent leg 26P of the safety lever 20P. Opposite to the first detent surface 28P is a shaft 42P about which the coil spring 36P is inserted. The shaft 42P is of a smaller cross sectional area than the bottom side of the first detent surface 40P such that a rim 44P is formed upon which an end of the coil spring 36P abuts. The cross sectional shape of the bore 32P is substantially the same as that of the outer perimeter of the first detent surface, but with adequate clearance such that the plunger is free to move axially within the bore 32P. The second end of the coil spring 36P abuts a shoulder 58P in the bore 32P of the cocking piece housing 18P.

As shown in FIG. 10 where the safety lever 20P is in the third position (ZP) wherein the bolt 14P and the firing pin 16P are both in the locked position, the first detent surface 40P of the plunger 34P makes direct contact with the detent leg 26P of the safety lever 20P at a position that is not aligned with the first and second detent apertures 28P, 30P of the safety lever 20P. The shaft 42P of the plunger 34P is urged into a locking aperture 60P on the end of the bolt 48P. In this configuration, the shaft 42P fully secures the bolt 14P from rotating relative to the cocking piece housing 18. A portion of the safety lever 20P stops the firing pin having the cocking piece 16P from forward movement.

As shown in FIG. 11 where the safety lever 20P is in the second position (YP) wherein the bolt 14P is in an unlocked position, but the firing pin 16P is in a locked position, the first detent position 40P of the plunger 34P makes contact with the detent leg 26P of the safety lever 20P at a position such that the first detent portion 40P of the plunger 34P is urged into the second detent aperture 30P of the safety lever. When the plunger 34P is in this position, the shaft 42P of the plunger 34P is fully retracted from the bolt 14P such that the bolt 14P is free to rotate. As in the third position (ZP) described above, a portion of the safety lever 20P stops the firing pin having the cocking piece 16P from forward movement.

Finally, in the first position (not shown) where the safety is in a position where both the bolt and the firing pin are unlocked and ready to fire, as is similar to the third position (YP) of FIG. 11, the first detent position 40P of the plunger 34P makes contact with the detent leg 26P of the safety lever 20P at a position such that the second detent portion 40P of the plunger 34P is urged into the first detent aperture 28P in the safety lever 20P. When the plunger 34P is in this position, the shaft 42P of the plunger 34P is fully retracted from the bolt 14P such that the bolt 14P is free to rotate. However, the firing pin having the cocking piece 16P may now have forward movement such that the rifle may be fired.

Here, when the plunger 34P is fully retracted, the bolt 14P is free to rotate. A separate set of features provides for detent positioning of the bolt when it rotates from a fully clockwise position to a fully counterclockwise position. These features include a breech bolt sleeve lock, a breech bolt sleeve lock spring, and a breach bolt sleeve lock pin. The present invention eliminates the need for these elements. Moreover, additional machining steps are required on the bolt 14P, for example, to provide for a detent position of the bolt 14P. Again, these machining steps are not required in the present invention. These features are very well known and are shown in Model 70 rifle designs and are shown, for example, in Winchester's Gun Parts Price List for its Model 70 Stealth Bolt Action Centerfire Rifle.

Although illustrated and described herein with reference to specific embodiments, the present invention nevertheless is not intended to be limited to the details shown. Rather, various modifications may be made in the details within the scope and range of equivalents of the claims without departing from the spirit of the invention.

What is claimed is:

1. A three-position safety for a firearm, said firearm having a bolt, a firing pin having a cocking piece, and a cocking piece housing, said bolt axially rotatable relative to the cocking piece housing, said safety comprising:

(A) a safety lever being rotatable in said cocking piece housing from a first position wherein the bolt and the firing pin are each in an unlocked position, to a second position wherein the bolt is in the unlocked position and the firing pin in a locked position, to a third position wherein both the bolt and the firing pin are in locked positions;

(B) said safety lever having a handle, a pivot point, and detent leg, said detent leg having a first detent aperture corresponding to the first position and a second detent aperture corresponding to the second position;

(C) a bore in the cocking piece housing that provides an opening between an end of the bolt and the detent leg, the end of the bolt having an end adjacent to the cocking piece housing;

(D) a plunger having a first detent surface to mate with one of the first and second detent apertures on the detent leg and a shaft opposite to the first detent surface;

(E) a detent member having a second detent surface to mate with a third detent aperture and a fourth detent aperture on the end of the bolt adjacent to the cocking piece housing;

(F) a biasing member to urge the plunger towards said lever and to urge the detent member towards the end of the bolt adjacent to the cocking piece housing;

(G) wherein when said safety lever is in said first position, wherein the bolt and firing pin are in the unlocked position, said first detent surface of the plunger is urged by the biasing member to extend into the first detent aperture in the safety lever, said second detent surface of the detent member is urged into the third detent aperture on the end of the bolt, and a gap exists between the shaft of the plunger and the detent member allowing for rotational movement of the bolt relative to the cocking piece housing;

(H) when the safety lever is in said second position, wherein the bolt is in an unlocked position and the firing pin in a locked position, said first detent surface of the plunger is urged by the biasing member to extend into the second detent aperture in the safety lever, said second detent surface of the detent member is urged into third detent on the end of the bolt, and a gap exists between the shaft of the plunger and the detent member allowing for rotational movement of the bolt relative to the cocking piece housing; and (I) when the safety lever is in the third position, wherein the bolt and the firing pin are in locked position, said first detent surface of the plunger contacts the safety lever at a position that is not aligned with the first and second apertures of the safety lever and said second detent surface of the detent member is urged into third detent on the end of the bolt, such that the shaft of the plunger contacts the detent member such that no rotational movement of the bolt relative to the cocking piece housing is provided.

2. The three-position safety for a firearm of claim 1, wherein the biasing member is a coil spring coaxial to the shaft extending between a point adjacent to the first detent surface of the plunger to the detent member.

3. The three-position safety for a firearm of claim 1, wherein the detent member is a ball.

4. The three position safety for a firearm of claim 1, wherein the detent member is a second plunger having a second detent surface.

5. The three position safety for a firearm of claim 4, wherein the second plunger has a second detent surface to mate with the detent aperture on the end of the bolt adjacent to the cocking piece housing.

6. The three-position safety for a firearm of claim 5, wherein the biasing member is a coil spring coaxial to the shaft extending between a point adjacent to the first detent surface of the plunger to the a point adjacent to the second detent surface of the second plunger.

* * * * *